US006273835B1

(12) United States Patent
Battis et al.

(10) Patent No.: US 6,273,835 B1
(45) Date of Patent: Aug. 14, 2001

(54) HOCKEY STICK BLADE SLEEVE

(76) Inventors: Steven M. Battis, 4590 W. Arm Rd., Spring Park, MN (US) 55384; Randy D. Scofield, 1031 Fremont St., Anoka, MN (US) 55303

( * ) Notice: Subject to any disclaimer, the term of this patent is extended or adjusted under 35 U.S.C. 154(b) by 0 days.

(21) Appl. No.: 09/468,379

(22) Filed: Dec. 20, 1999

Related U.S. Application Data

(63) Continuation-in-part of application No. 08/949,590, filed on Oct. 14, 1997, now abandoned.

(51) Int. Cl.[7] ..... A63B 59/14
(52) U.S. Cl. ..... 473/563
(58) Field of Search ..... 473/560–563, 473/FOR 189

(56) References Cited

U.S. PATENT DOCUMENTS 2,912,245 * 11/1959 Gardner et al. ..... 473/563
3,353,826 * 11/1967 Traverse ..... 473/563
4,148,482 * 4/1979 Harwell, Jr. et al. ..... 473/563
5,558,326 * 9/1996 Adamson et al. ..... 473/563
5,836,841 * 11/1998 Fell ..... 473/563

FOREIGN PATENT DOCUMENTS 53-38430 * 8/1978 (JP) ..... 473/FOR 189

* cited by examiner

*Primary Examiner*—Mark S. Graham
(74) *Attorney, Agent, or Firm*—Janet Peyton Schafer

(57) ABSTRACT

An elastomeric coated fiber weave sleeve for use as a hockey stick protector provided as an easy to position sleeve that fits snugly over the blade of a conventional hockey stick. The two-layer sleeve provides easy installation and protects the hockey stick from both water infiltration and wear along the bottom surface of the hockey stick blade. The sleeve has topographical features including horizontal grooves for removing water from the surface of the hockey stick which results in increased friction between hockey puck and blade. The topographical features further include nubs formed between at least some of the horizontal grooves, the nubs providing temporary attachment between the protector and a cross-hatched perimeter edge of a conventional hockey puck. The topographical features further include vertical ribs formed along the bottom edges of the protector provided to resist sliding ofthe puck along the blade increasing control ofthe puck, and reducing friction between the blade and the ice.

3 Claims, 6 Drawing Sheets

HOCKEY STICK BLADE SLEEVE

This is a continuation-in-part application of patent application Ser. No. 08/949,590, filed Oct. 14, 1997, now abandoned.

BACKGROUND

The present invention is directed to a new and useful detachable protective device for hockey sticks.

There have been numerous attempts to add reinforcement to the blade of a hockey stick. For ii example, tape applied to the hockey stick has been widely used to lengthen the life of a hockey stick. Plastic sleeves taped to the hockey stick have also been used. Additionally, there have been previous attempts to reinforce the stick itself by means of permanent attachments to the blade including a textile tubing slipped over the blade after which a resinous coat is applied over the tubing incorporating it permanently to the blade. Further attempts at reinforcement include using glass fiber material impregnated with a resin plastic applied to the blade and becoming a permanent part of the blade.

A problem with using tape to reinforce the blade portion of a hockey stick has been that tape is time consuming and difficult to apply. Also, tape has little aesthetic value and tape allows water to wick or be absorbed into the hockey stick causing damage to the stick reducing the usability of the stick. The plastic, fiberglass, and textile products are costly, difficult to apply to the hockey blade, "deaden" the puck requiring more force to catapult the puck along, and lessen the control over the puck.

While these prior devices may be suitable for the particular purpose to which they address, they would not be as suitable for the purposes of the present invention as described herein.

SUMMARY

The present invention is directed to a hockey stick blade sleeve that satisfies these needs to provide an economical, aesthetic hockey stick protector that increases the wear protection along the bottom of the hockey stick blade, improves the puck handling, decreases friction between the blade and the ice and is easy to position on the blade. A hockey stick blade sleeve having features of the present invention comprises a fiber weave elastomeric sleeve for use as a protective cover on a blade end of a hockey stick, the sleeve having a proximal surface and a distal surface continuously interconnected to form a tube. The sleeve further has a first end and a second end whereby the sleeve may be manually positioned onto a hockey stick. The sleeve is made of fiber weave material encapsulated in rubber having a durometer strength within a range of 30 and 100 durometers. The fiber weave material is constructed into a tube, open at each end, and bonded through a molding process, such as compression molding or injection molding, to an elastomer coating layer. The rubber encapsulated fiber weave sleeve has formed in the outer surface thereof topographical features that add to its performance. The elastomer coating layer provides a smooth interface between the blade and the ice that has far less friction than conventional hockey tape. The topographical features of the elastomer coating also provides for improved contact between the puck and the blade of the hockey stick. The elastomer coating, in combination with the fiber material, serves as a constrictor directing forces inwardly toward the hockey stick blade and act in place of a bonding agent with the blade. The mechanical force replaces the need for adhesive or heat-shrink bonding necessary in other art. The fabric material provides a one-way stretch arranged such that the material stretches across the diameter of the hockey stick blade providing stabilization in a longitudinal direction of the sleeve across the length of the hockey stick blade thus preventing the sleeve from shifting while in its position of use on the hockey stick blade.

The elastomer coated fiber weave sleeve with at least a one-way stretch enables the user to apply the sleeve to the hockey stick blade without the assistance of any tools. The sleeve stretches over the blade diameter for installation and then the elastomeric forces inherent in the materials snaps back and holds the sleeve in position on the hockey stick blade. The elastomer coated fiber weave sleeve enables the user to apply the sleeve to the hockey stick blade and later remove it and re-apply it to another stick without any reduction in performance. The materials used enable the sleeve to by far outlive a hockey stick taping and, because the sleeve doesn't disintegrate like tape, no debris is dropped on the ice.

The topograpical features provide means for directing away melted ice thus providing a dry surface for interaction of a conventional puck and a sleeve-covered hockey stick. A series of horizontal grooves formed on the proximal and distal surfaces provides the means for directing away melted ice are the grooves for receiving and directing away melted ice.

A series of nubs are formed in the sleeve between at least some of the horizontal grooves, the nubs provide means for temporarily adhering the sleeve surface to an edge surface of a hockey puck, the cross-hatched perimeter edge of a conventional hockey puck providing attachment surfaces for the nubs, increasing friction between the puck and the sleeve-covered hockey stick for increasing control of the puck.

A series of vertical ribs, formed along the length of said sleeve, are provided to receive a cross-hatched edge portion of a hockey puck therebetween, such that a three-pointed point of attachment is formed between the puck and the sleeve-covered hockey stick, for resisting sliding of the puck against the sleeve, for increasing control of handling and shooting of the puck. These vertical ribs prevent the puck from slipping across the blade. Instead, they cradle the puck, allowing the puck to roll across the blade for better control.

Another sleeve embodiment has increased amounts of elastomeric materials at the top portion and bottom portion thereof to provide increased strength and resistance to wearing from contact of the sleeve covered hockey stick and the ice. The elastomeric coated fiber weave sleeve can be constructed of materials in a combination of different values of hardness to allow selected hardened regions to extend wear and soft regions for improved puck control.

Advantages over conventional tape include being stronger than tape and easier to apply than tape. No tools are needed for installation. The elastomeric coated fiber weave sleeve is easy to install. Because the internal wall is fabric, there is less friction than if the internal wall were made of rubber. The elastomeric coated fiber weave sleeve protects the hockey stick blade from wear better than conventional tape. The elastomeric coated fiber weave sleeve performs better in stick handling, shooting, passing and pass receiving. Because it is a thin sleeve, the sleeve presents lower profile on the stick. And further, because it is a thin sleeve, with a lower durometer value, it provides a softer sleeve which improves puck handling. This reduction of materials also reduces the cost of manufacture. The elastomeric layer bonded to the fabric layer is much more resistant to cuts than conventional materials. And the elastomeric coated fiber weave sleeve is re-usable. The sleeve provides an economic, aesthetic, re-usable protective cover for a hockey stick blade and may be used for either a right-handed or left-handed hockey stick.

BRIEF DESCRIPTION OF THE DRAWINGS

Understanding ofthe invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but nonlimiting example.

Figure 1:
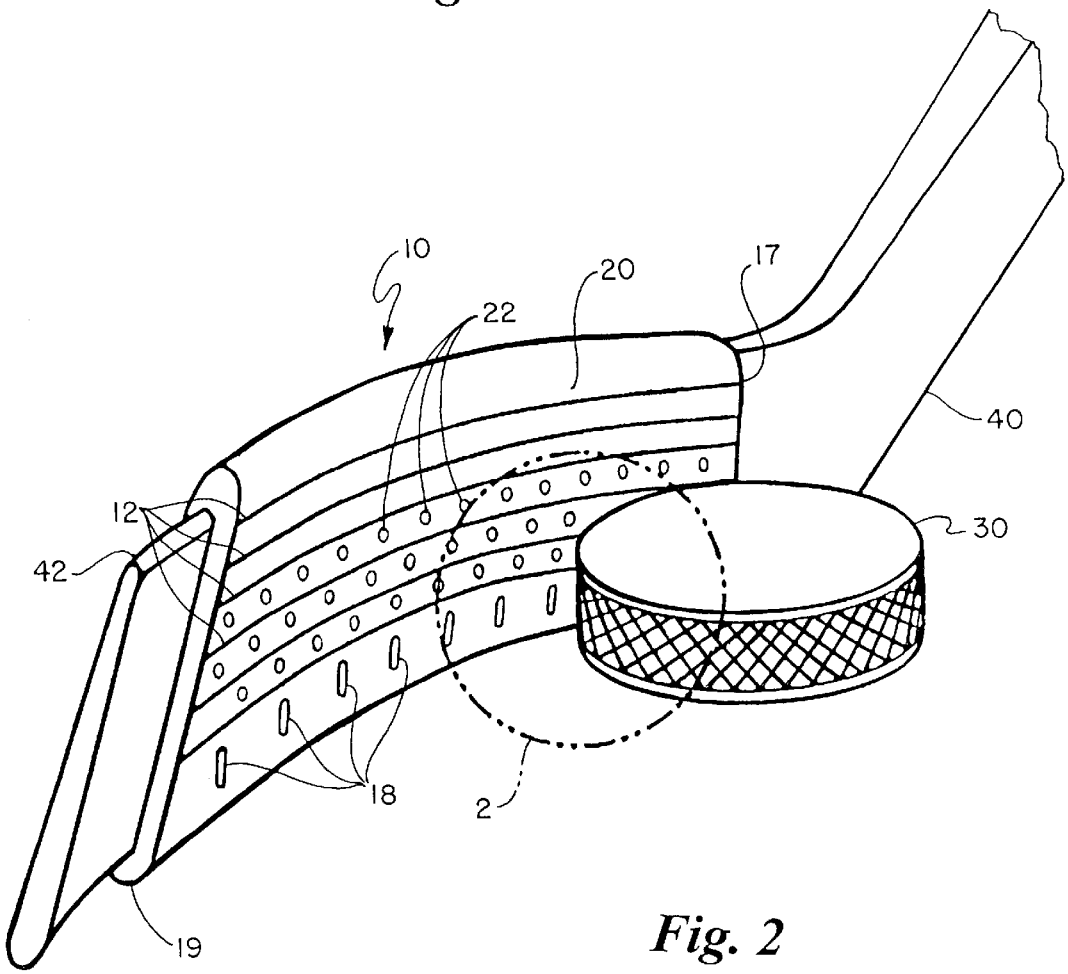
FIG. 1 is a perspective view showing the hockey stick blade sleeve in its place of use on a hockey stick.

Turning now to the drawings, in which like reference characters refer to corresponding elements throughout the several views, FIG. 1 illustrates a hockey stick blade sleeve 10, having a series of horizontal grooves 12, vertical ribs 18 and circular nubs 22 formed therein, for use on the blade end 42 of a hockey stick 40. The sleeve 10 acts to protect the hockey stick blade 42 from both moisture from the melting ice and to reduce friction between the ice surface and the hockey stick blade 42. The horizontal grooves 12, vertical ribs 18 and nubs 22 formed on the sleeve 10 interact with a hockey puck 30 to increase control over the movement of the hockey puck 30 when the sleeve 10 is in its place of use on the blade end 42 of a hockey stick 40.

Figures 7, 8, 9:
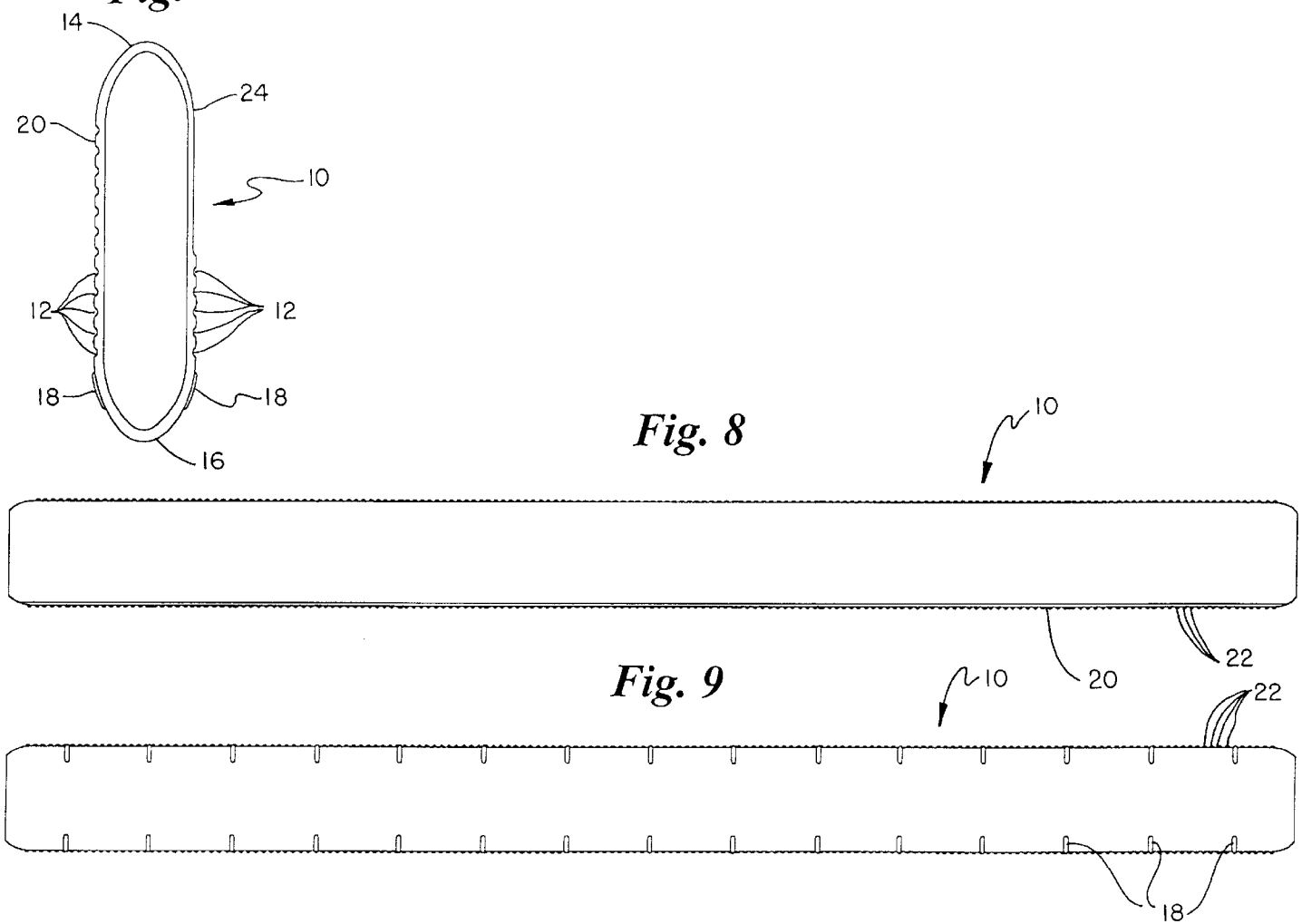
FIG. 7 is an end view of the hockey stick blade sleeve of FIG. 1.
FIG. 8 is a top view of the hockey stick blade sleeve of FIG. 1.
FIG. 9 is a bottom view of the hockey stick blade sleeve of FIG. 1.

The oblong-shaped hockey stick blade sleeve 10, as shown in FIG. 7, has an elastomeric coating layer 52, in actual use conditions of EPDM (ethylene propylene) however other closed cell elastomeric materials having a durometer strength in a range between 30–100 durometers, such as SBR (styrene butyl rubber), stretchable polymers, plastics or natural rubber could be used. An inner fiber weave layer 50 is formed of one continuous piece shaped as a tube. One embodiment of sleeve 10 additionally has thicken portions at the top portion 14 and at the bottom portion 16 providing added strength to the sleeve 10 both for resisting friction wear of the sleeve 10 and to provide more material at the stress points of the sleeve 10 when manually positioned on the hockey stick blade 42.

Figure 2:
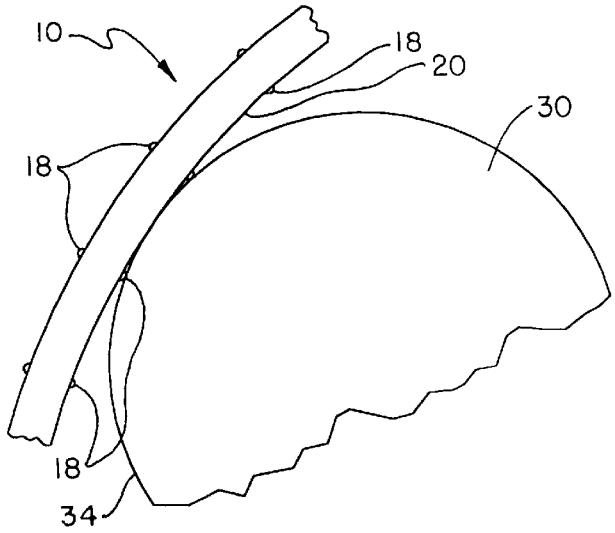
FIG. 2 is an enlarged top view, with parts broken away for ease of understanding, of the circled area of FIG. 1.
Figure 6:
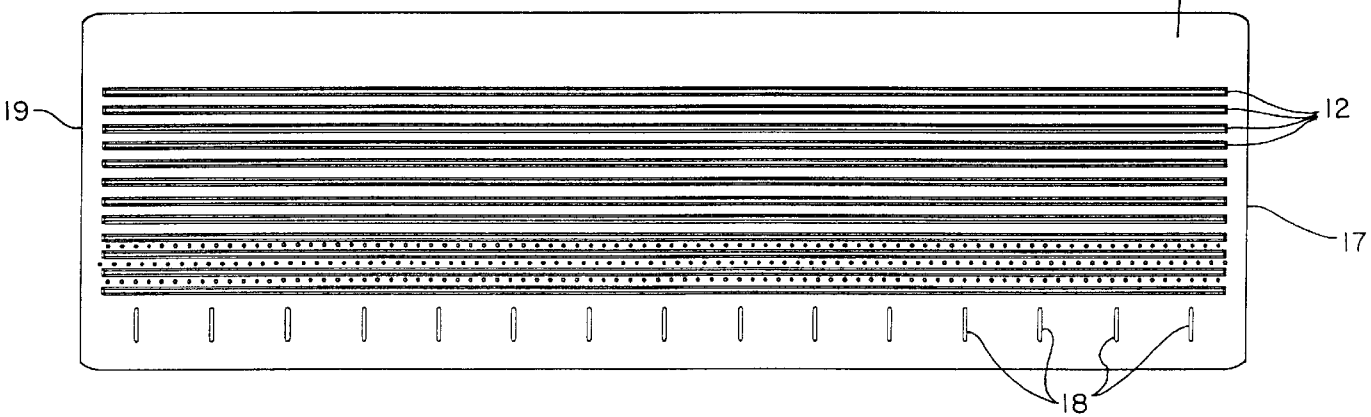
FIG. 6 is a left side view of the hockey stick blade sleeve of FIG. 1.

The topographical features of sleeve 10 enhance the performance of sleeve 10. Formed along a proximal surface 20, shown at FIGS. 1, 2 & 6 are a series of horizontal grooves 12 that channel melted ice away from the blade. Sleeve 10 prevents moisture from accumulating on blade 42 interfering with control of the puck 30 and prevents moisture from being wicked into blade 42 in the manner of a taped blade, not shown. A series of vertical ribs 18 are also formed in the proximal surface 20 of the sleeve 10, the ribs 18 resisting sliding of the puck against the hockey stick blade 42, thereby increasing control of the puck by the user. A series of circular nubs 22 are also formed in the proximal surface 20 of the sleeve 10, the nubs 22 acting in a lock and key effect with the cross hatch pattern 32 formed on the puck edge 34. The nubs 22 are positioned on sleeve 10 a specified distance apart from each other between the horizontal grooves 12 so that the nubs 22 just fit between the cross hatch 32 of puck edge 34. This interaction of the nubs 22 and cross hatch 32 increases friction between puck 30 and hockey stick blade 42. All of these physical elements, horizontal grooves 12, vertical ribs 18 and nubs 22 increase friction between the hockey puck 30 and the blade 42 increasing vertical ribs 18 and nubs 22 increase friction between the hockey puck 30 and the blade 42 increasing the stick handler's control over the puck 30 both for passing and shooting. Increasing control is a marked improvement over the prior art. Additionally, sleeve 10 cushions puck 30, especially an out of control puck, increasing control over puck 30.

Figure 3:
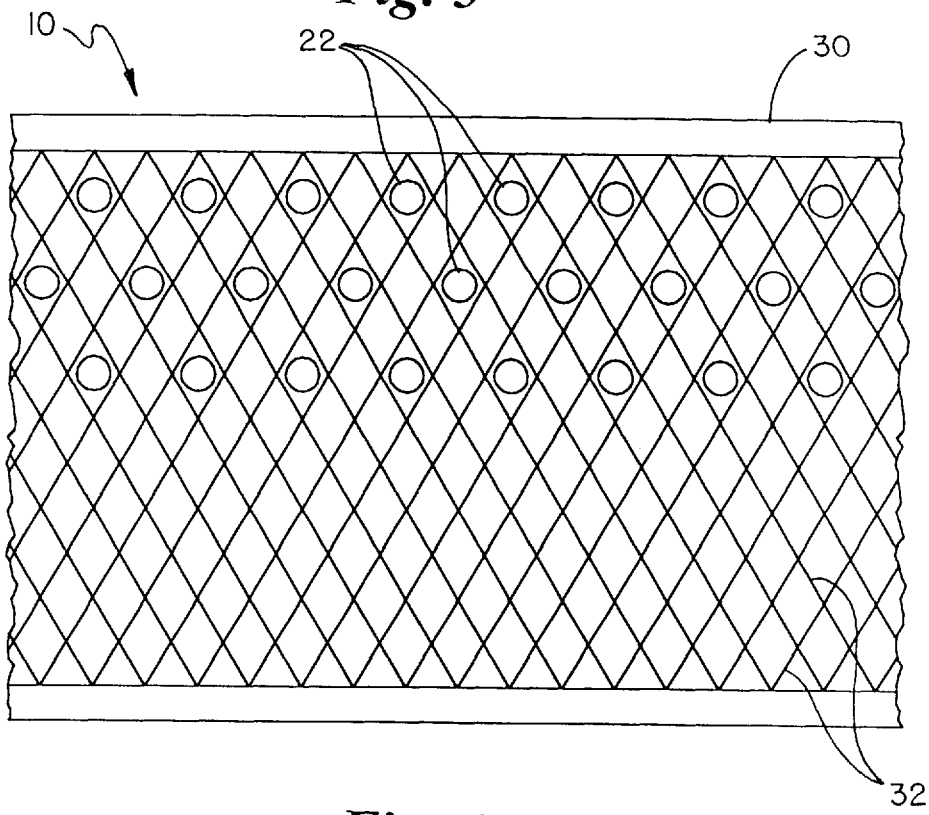
FIG. 3 is an enlarged view of interaction of the puck and the hockey stick blade sleeve.

FIG. 2 is an enlarged view of the hockey puck 30 in contact with sleeve 10, the puck side edge 34 in contact with the ribs 18. Ribs 18 are designed to prevent the puck from slipping across the hockey stick blade. Ribs 18 cradle the puck, thus allowing the puck to roll across the blade resulting in better control by the user. FIG. 3 is an enlarged view ofthe nubs 22 of sleeve 10 positioned within the cross hatch 32 edge of puck 30. Cross hatch 32 receives nubs 22 preventing puck 30 from spinning, turning, or sliding, increasing control of puck 30 by hockey player. Nubs 22 are designed to inter-lock with the cross-hatch 32 pattern on the puck for better surface contact and subsequent control of the hockey puck.

Figure 4:
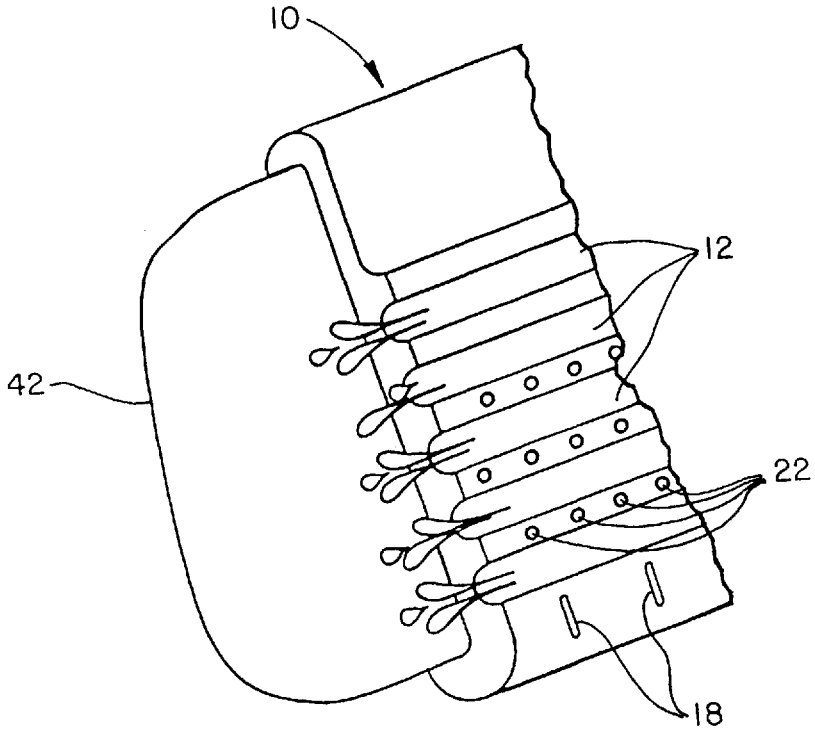
FIG. 4 is an enlarged view of a first end of the hockey stick blade sleeve in its place of use on a hockey stick, with parts broken away for ease of understanding.

FIG. 4 illustrates the moisture, in the form of melted ice or water, being sloughed off the sleeve 10 mounted on the hockey stick blade 42. Horizontal grooves 12 direct moisture away from the hockey stick blade providing both better contact between puck and sleeve-covered hockey stick blade and the grooves 12 further reduce the weight of the sleeve-covered hockey stick blade.

The sleeve 10 can be constructed using materials in a combination of different values of hardness to allow selected hardened regions to resist wear while having soft regions for improved puck control. This dual durometer construction permits the sleeve 10 to be harder at e.g. the top and the bottom edge of the sleeve 10.

Figure 5:
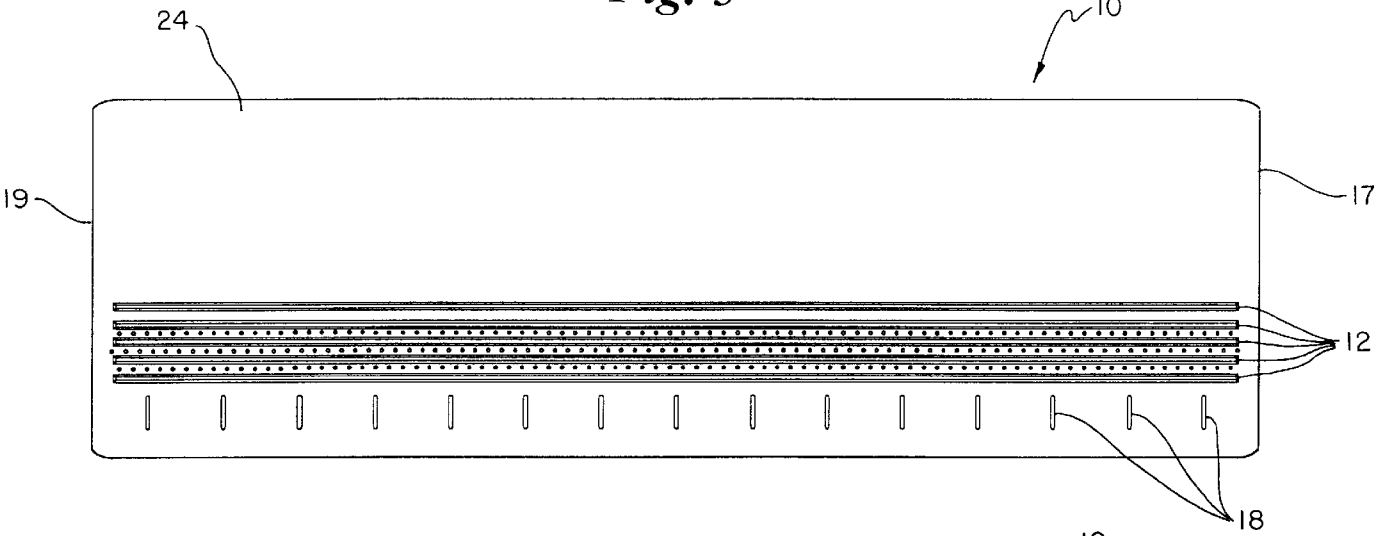
FIG. 5 is a right side view of the hockey stick blade sleeve of FIG. 1.

FIG. 5 illustrates the distal surface 24 of sleeve 10 with a series of grooves 12 extending toward the ends 17, 19 of sleeve 10. Team logos, and colors may be imprinted on sleeve 10 on this distal surface 24, the outside of hockey stick blade 42, allowing spectators to see the logos, etc. Use of color and or logos provide a uniform appearance to sleeve 10.

FIG. 6 shows the proximal surface of sleeve 10 also with a series of grooves 12, vertical ribs 18 and nubs 22 formed therein. Because this is the side of the sleeve 10 that most frequently comes into contact with the puck 30, more grooves 12 are provided. The grooves 12, ribs 18 and nubs 22 act in similar fashion as described above.

FIG. 7 shows an end of sleeve 10, one end being a mirror image of the other, showing the thickened top portion 14, bottom portion 16, grooves 12 and ribs 18 formed in sleeve 10.

FIG. 8 is a top view of sleeve 10 and FIG. 9 is a bottom view of sleeve 10.

Figure 10:
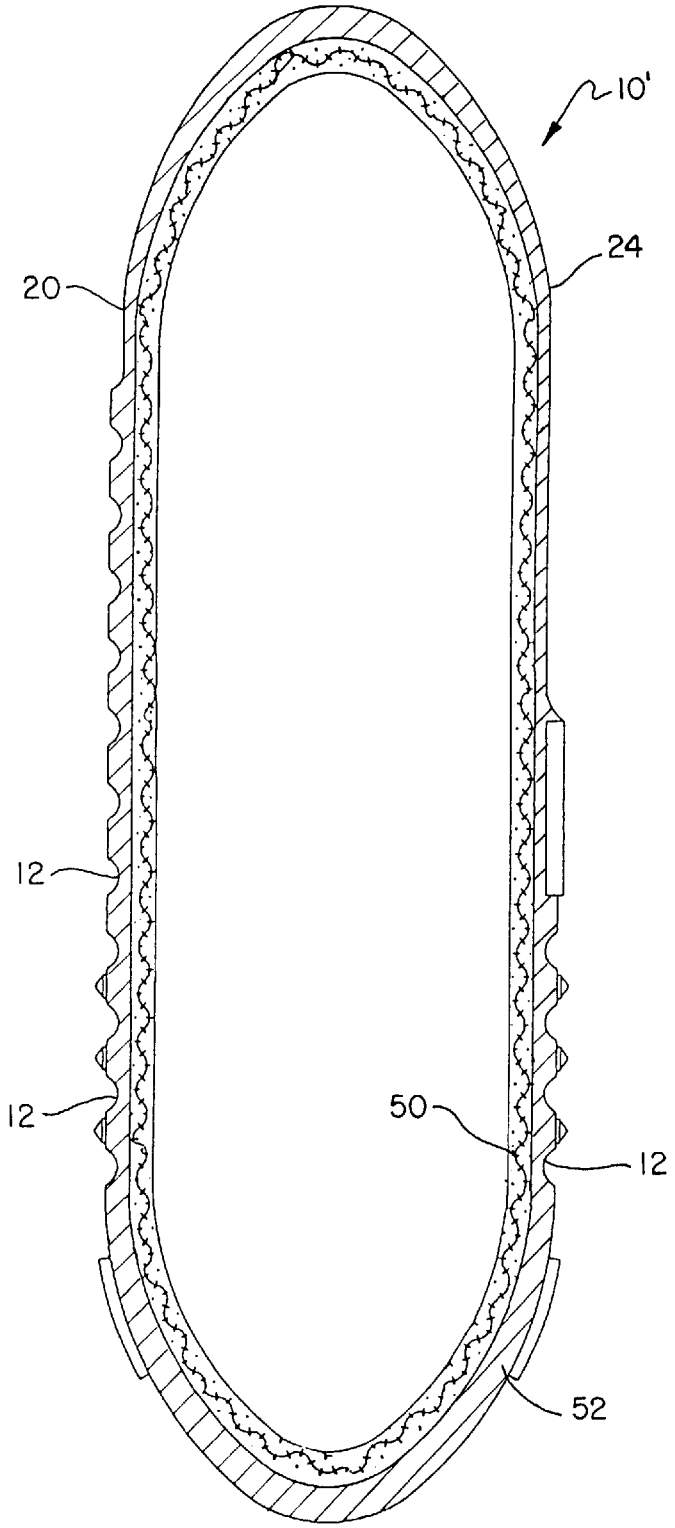
FIG. 10 is a cross-section view of a second embodiment hockey stick blade sleeve of FIG. 1.

FIG. 10 is a cross-sectional view of the sleeve having a fabric or fiber weave layer 50 with a rubberized elastomeric coating layer 52 bonded thereto. The fiber weave layer 50 can be braided, knit, woven or anything of the like and made of any individual or combination of fabric-like materials such as Kevlar®, Spectra®, Vectron®, Lycra®, polyester, nylon, fiberglass, Dacron®, and cotton although other fabric materials could be used. The elastomeric coating layer 52 is molded onto or impregnated around the fiber weave layer 50.

The elastomeric coating layer 52 has various topographical features that enhance the performance of the sleeve 10. The elastomeric coating layer 52 provides a smooth surface to interface between the hockey stick blade and the ice because of the lowered friction as compared to a taped hockey stick blade. Additionally, the elastomeric coating layer 52 provides a lowered friction level as compared to a taped hockey stick blade when the ice has been roughed up, e.g. towards the end of a hockey game time period.

Figure 11:
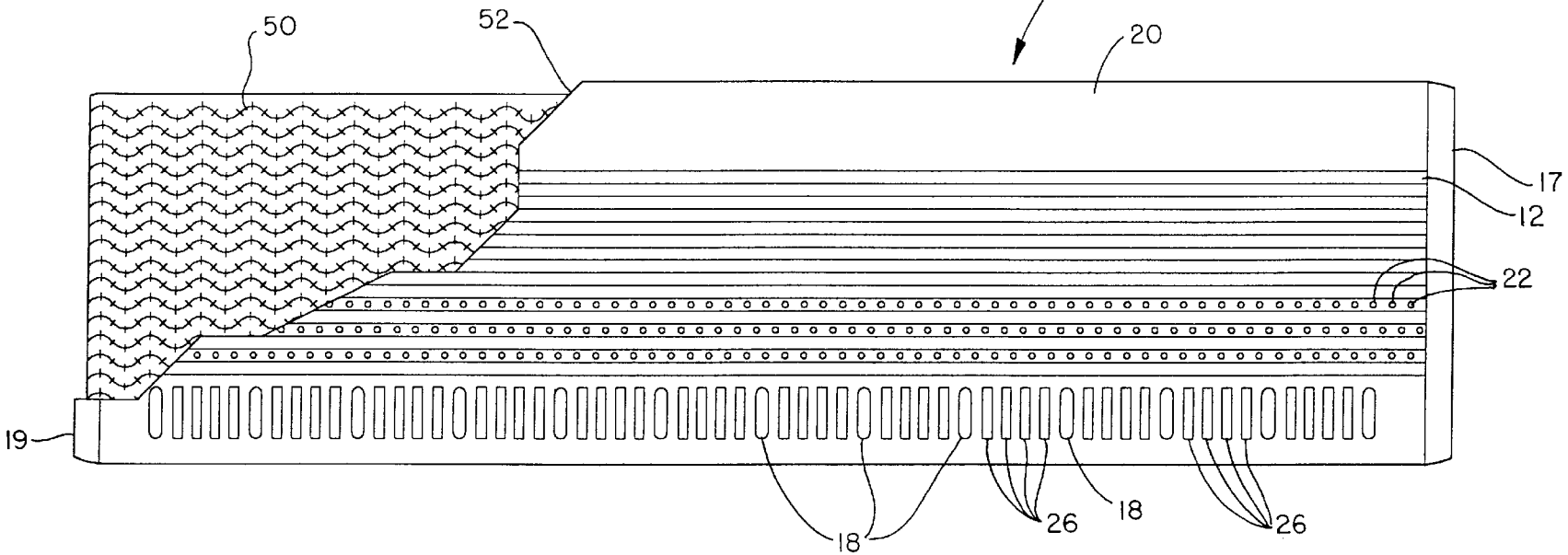
FIG. 11 is a side view with parts broken away for ease of understanding.

FIG. 11 is a side view of the sleeve 10' with parts removed for ease of understanding that the inner layer is a fabric layer 50 with the elastomeric coating layer 52 embedded thereto. FIG. 11 illustrates a hockey stick blade sleeve 10', having a series of horizontal grooves 12, vertical ribs 18, vertical slots 26, and circular nubs 22 formed therein, for use on the blade end 42 of a hockey stick 40. These topographical features work in similarly as mentioned above. In addition, vertical slots 26 work to enable the sleeve 10' to bend inwardly toward the proximal surface 20 enhancing the effect of the vertical ribs 18 in grasping the puck. Vertical slots 26 are formed as inward vertical ribs. The sleeve 10 acts to protect the hockey stick blade 42 from both moisture from the melting ice and to reduce friction between the ice surface and the hockey stick blade 42. The horizontal grooves 12, vertical ribs 18, vertical slots 26, and nubs 22 formed on the sleeve 10' interact with a hockey puck 30 to increase control over the movement of the hockey puck 30 when the sleeve 10' is in its place of use on the blade end 42 of a hockey stick 40. In use, the sleeve 10' is positioned on blade 42 by placing sleeve end 17, or sleeve end 19, depending if for a right-handed or left-handed hockey stick, over the handle of hockey stick 40 and pulling sleeve 10' into position with proximal surface 20 on the inside edge of blade 42. The simplicity of placing the sleeve 10' on blade 42 is an important advantage of the present invention over the prior art.

Sleeve 10 and 10', when in place on the hockey stick blade 42, reduces friction between blade 42 and the ice surface as compared to conventional tape, not shown. This reduction in friction allows better hockey stick blade 42 handling. Further, the sleeve 10 and 10' on the hockey stick blade 42 prevents "wicking" of water into the hockey stick blade deteriorating the blade, thus the sleeve 10 and 10' helps prevent the hockey stick blade from wearing out prematurely. An additional advantage is that it is much faster to position sleeve 10,10' on hockey stick blade 42 than it is to tape such a hockey stick blade 42. Further, the sleeve 10,10' is reusable while tape is never reusable. Sleeve 10,10' can be reversed to fit either a right handed or left handed hockey stick. Also, sleeve 10,10' is made of recyclable material. Sleeve 10,10' retains its position on hockey stick blade 42 without the use of any adhesive or other fastening means. The natural elasticity of the material used to make sleeve 10,10' allows it to be stretched into position whereupon sleeve 10,10' snaps back into shape. The elastomeric coating layer, in combination with the fiber layer, serve as a constrictor directing forces inwardly toward the blade of the hockey stick and act in place of a bonding agent with the blade. This mechanical bonding force replaces the need for adhesive or heat-shrink bonding, necessary in other art. This elasticity also aids in keeping sleeve 10,10' in position once mounted on hockey stick blade 42. The materials used to manufacture sleeve 10,10' also resist tearing, as opposed to tape, reducing the amount of debris on the ice. Because the fabric material used has a one-way stretch, the sleeve 10,10' stretches across the diameter of the sleeve 10,10' only, not longitudinally over the length of the sleeve 10,10'. This design resists collapse in the longitudinal direction thus preventing the sleeve 10,10' from shifting along the length of the hockey stick blade once the sleeve 10,10' is in position. This elasticity also permits tool-free installation of the sleeve 10,10' on the hockey stick blade. The relatively thinner walls of the sleeve 10' lightens the sleeve 10 which results in better stick handling. The relatively thinner walls of sleeve 10,10' makes the sleeve lighter in weight, thus reducing the materials needed and reduces the cost of manufacture. The thinner walls permit easier installation, even as compared to earlier embodiments. The user stretches the diameter of the sleeve 10,10' during installation and the fabric material snaps back to the original shape once the sleeve 10,10' is in position. The sleeve 10,10' may by de-installed in the same too-free manner for placement on another hockey stick without any reduction in performance. This re-useable feature also reduces costs.

Although the present invention has been described in considerable detail with reference to certain preferred versions thereof, other versions are possible. The sleeve could be of a different shape, i.e. as a parallelogram, as a trapezoid and other configurations. Other surface textures could be used as could grooves of different numbers and shapes. Additionally, one could form the sleeve as a sheet and use fastening means to retain on the hockey stick blade. Therefore, the spirit and scope of the appended claims should not be limited to the description of the preferred versions contained herein.

What is claimed is:

1. A hockey stick blade sleeve for use on a blade end of a hockey stick for interaction between a conventional hockey stick and a conventional hockey puck on an ice surface, comprsing:

a sleeve having at least two layers, for use as a protective cover on a blade end of a hockey stick, said sleeve having a proximal surface and a distal surface continuously interconnected to form a tube having a first end and a second end;

means whereby said sleeve may be manually positioned onto a hockey stick;

means for improving contact between the puck and the hockey stick blade;

said sleeve further comprising a fiber weave first layer;

said sleeve further comprising an elastomeric second layer bonded to said fiber weave first layer;

said elastomeric second layer of materials having a durometer strength within a range of 30 and 100 durometers;

said elastomeric second layer providing means for decreased friction between the hockey stick blade and the ice, said means including a smooth interface between the hockey stick blade and the ice;

said means for improving contact between the puck and the hockey stick blade further comprise a series of topographical features on said proximal and distal surfaces;

said topographical features further comprising horizontal grooves formed on said proximal surface, said grooves for receiving and directing away melted ice for providing a dry surface for interaction of a puck and said sleeve covered hockey stick; and said topographical features further comprising a series of nubs formed between at least some of said horizontal grooves, said nubs further providing means for temporarily adhering to an edge surface of a hockey puck, the cross-hatched perimeter edge of a conventional hockey puck providing attachment surfaces for said nubs, increasing friction between the puck and sleeve-covered hockey stick for increasing control of the puck.

2. The device of claim 1, wherein said means whereby said sleeve may be manually positioned onto a hockey stick further comprises, said fiber weave first layer providing a one-way stretch across the cross-section of the hockey stick blade, wherein said sleeve may be stretched for installation while said elastomeric second layer provides a constricting force holding said sleeve in place after being positioned on the hockey stick blade.

3. The device of claim 2, further comprising means for manually removing said sleeve for re-use on a new hockey stick blade.

* * * * *